US009364731B2

(12) United States Patent
Chorne

(10) Patent No.: US 9,364,731 B2
(45) **Date of Patent: *Jun. 14, 2016**

(54) BALANCED LOWER CENTER OF GRAVITY HOCKEY STICK BLADE

(71) Applicant: Robert Chorne, Freeport, NY (US)

(72) Inventor: Robert Chorne, Freeport, NY (US)

(73) Assignee: DJPZ HOLDINGS LTD., Freeport, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/544,431

(22) Filed: Jan. 6, 2015

(65) Prior Publication Data

US 2015/0328513 A1 Nov. 19, 2015

Related U.S. Application Data

(60) Provisional application No. 61/964,494, filed on Jan. 6, 2014.

(51) Int. Cl.
*A63B 59/14* (2006.01)

(52) U.S. Cl.
CPC ..... *A63B 59/14* (2013.01); *A63B 59/70* (2015.10); *A63B 2225/01* (2013.01)

(58) Field of Classification Search
CPC . A63B 59/70; A63B 2102/22; A63B 2102/24
USPC ..... 473/560–563; D21/727
See application file for complete search history.

(56) References Cited

U.S. PATENT DOCUMENTS 682,807 A * 9/1901 Minor ..... A63B 9/70 473/563
D237,636 S * 11/1975 Leclerc ..... 473/560
D325,412 S * 4/1992 Dauguard ..... D21/727
5,429,352 A * 7/1995 Leclerc ..... A63B 59/70 473/563
5,486,000 A * 1/1996 Chorne ..... A63B 53/04 473/350
5,511,776 A * 4/1996 Huru ..... A63B 59/70 473/563
5,810,684 A * 9/1998 Ohman ..... A63B 59/70 473/563
5,816,949 A * 10/1998 Dutchburn ..... A63B 59/70 473/563
7,980,969 B1 * 7/2011 Hochberg ..... A63B 59/70 473/563
D716,884 S * 11/2014 Chorne ..... D21/727
2003/0004019 A1 * 1/2003 Lussier ..... A63B 59/70 473/563

* cited by examiner

*Primary Examiner* — Mark Graham

(57) ABSTRACT

A hockey stick blade of a type having a puck-striking body of weight and an imparting construction material inclined at a selected angle for driving a struck puck a corresponding selected height during its trajectory, has spaced-apart top and bottom surfaces bounding a striking surface there between. A method of improving weight distribution includes removing construction material from the top surface, relocating at least part of said removed construction material or its weight from top surface to clearance positions below the top surface located toward the bottom surface. The removed construction material is from a location not used during puck-striking service of the hockey stick blade, and the removed construction material in the relocated positions contribute to increasing the height attained by the puck struck by the blade.

4 Claims, 8 Drawing Sheets

BALANCED LOWER CENTER OF GRAVITY HOCKEY STICK BLADE

FIELD OF THE INVENTION

The present invention relates generally to improvements in hockey blades design and function, the manufacture and resulting construction of a hockey stick blade and more particularly, to "sweet spot"-enhancement of the ball or puck-striking surface of the blade, resulting in greater stick and blade speed and a reduction of twisting and vibration upon impact with the puck or ball.

BACKGROUND OF THE INVENTION

In a hockey stick blade, it is understood that the blade embodies what in hockey parlance, is known as a "sweet spot" which should be the medial location of the blade bounded in a vertical perspective between a top and bottom surface and in a horizontal perspective between a toe and a heel. It is also understood that most top players first make contact in the lower region-center area of the blade; however, the blade first rotates downward toward the ice as the center of mass is higher, too high in the blade, the impact occurs way below the center of mass of hockey blades. The puck or ball is finally released off the blade most often more towards the toe portion of the blade then the original contact point as the blade has rotated around its center of mass which causes the blades face to open. High speed slow motion has shown the impact typically or usually starts with the center of the blade, the blade then rotates around its center of mass and the puck ends up being released off the point more toward the toe. Even if the impact would start at the toe this would further increase the opening of the face as the blade which will rotate around its center of mass which is more toward the heel thereby opening the blade.

This is very inefficient transfer of energy and inefficient and inconsistent for directional control and transfer of energy and also shocks the player. Some people believe this is done to create higher speed, however, they are mistaking with the current designs; there is tremendous twisting that occurs upon impact with the puck or ball. The blades actions are controlling the player instead of the player controlling the blade. This leads to inconsistent dispersion pattern or shot inconsistency. Pucks make contact are most often received on the center to heel side of the blade as opposed to the toe for more control as it is closer to the center of mass than the toe. Even when others try to add stiffness to the toe, this does not change the weight distribution problem with the current blades, whereby the blade will still rotate around its center of mass and open the blades face upon impact. This is the case, because the heel side is closer to the center of gravity of the blade than the toe side on all other designs.

Others have added additional weight to the inside portions of the blade, not sourced from the blade itself, which adds to the overall weight of the blade and stick and is not desirable as this changes the overall weight of the stick to be heavier.

As the stick comes toward the puck (or ball) there is a rotational wobble of the blade as forces act upon the stick on the downswing. The blade wobbles in an opening and closing manner, unpredictable upon impact with a hockey puck or ball. Upon impact, the blade moves downward towards the ice as the blades center of mass tries to line up with the players hand plane. Upon impact with the puck or ball, the blade is trying to rotate around its center of mass. Since hockey blades have very unequal balance, due to the heavier hosel or neck portion, the majority of weight is in the heel section of the blade. When the puck first comes in contact with the center of the blade, the blade opens and the puck moves toward the toe as the blade is moving through contact and is released more toward the toe then the point of contact. This is very inefficient energy transfer along with a loss of directional control and trajectory control and consistency.

OBJECTS OF THE INVENTION

It is therefore an object of the present invention to provide an improved hockey stick blade for a hockey stick, for improved weight distribution in a hockey stick blade, the removal of weight, construction material, from a location thereon not intended to be used in play, namely centrally along a top edge of the blade-striking face, creating a lower center of gravity within the blade, better balance, greater enhanced heel toe weight distribution, greater shot speed, while allowing the use of any part of this removed weight (constructions mass removed) to be advantageously redistributed to the toe, sole, heel or combination thereof, to contribute to sweet spot-enhancement in at least two respects, viz. first, that weight in the removal location is a benefit even if not relocated elsewhere, and second that any weight that is relocated is being sourced from the blade itself, does not change the overall weight of the blade, which typically is selected to be according to the size and level of player.

Broadly, it is also an object of the present invention to remove unnecessary weight from the upper edge portions or regions of the blade—preferably on portions other than the toe side which provides in an improved weighted or improved mass, weight distribution hockey stick blade, overcoming the foregoing and other shortcomings of the prior art.

More particularly, it is an object to achieve, using weight distribution, sweet spot-enhancement, i.e. Significant improvement in ball or puck striking efficacy, while maintaining the same overall starting weight of the blade and even more important, without detracting from the blades configuration as it relates to its intended end use, namely striking a hockey puck or ball. The new blade is fully functional with the newly created hockey stick blade design with the removed material or removed weight being redistributed to lower regions creating greater stability, less vibration and more control with greater blade speed, a reduction in drag force, with more aerodynamic efficiency, less wind resistance.

SUMMARY OF THE INVENTION

In keeping with these objects and others, which may become apparent, the present invention is a hockey stick blade with a blade having a cutout on the top surface thereof. The blade is the part of the stick that hits the puck or ball when playing hockey. The blade is an integral part of the hockey stick. It is the only part that contacts the puck or ball.

On the new blade one can add weight inside the blade by sourcing weight from the blade itself, the reduced weight section which allows weight to be redistributed.

The blade of the new hockey stick blade invention may be made out of any suitable material such as carbon fiber, fiberglass, resin, wood, plastic, thermo plastic, engineered resin, foam, metal, titanium, multi material construction such as carbon fiber and foam or any combination of suitable materials and the above mentioned materials or combination of the materials. The manufacturing can be any suitable form of manufacturing such as injection molded, machined, formed, compression molded, co-molded or any combination of suitable methods such as injection molded, compression molded, hand wrapped, machine wrapped, CNC machined, formed, stamped, forged, handmade or any combination of suitable methods.

The newly developed hockey stick blade in this application improves the noted condition by removing weight and mass from the upper top region including center and heel weight-mass removal. The removal of weight from the high heel area shifts the center of gravity of the blade downward and toward the toe. This creates a blade with a lower center of gravity and achieves a center of gravity more toward the toe than before the removed weight. This now creates a more stable blade with a lower center of gravity, a more aerodynamic blade and shifts the center of gravity further away from the heel. In one preferred embodiment any portion of on up to all of the removed weight from the upper region can be relocated any combination or any of the lower regions of the blade with preference to shifting the center of gravity away from the heel. This means it moves toward the toe. This increases the benefit of lowering the center of gravity and allowing the center of gravity to shift toward the toe farther from the heel, more towards the center creating a better balanced, more stable blade for impacting a hockey puck or ball. In another embodiment any or all of the removed weight can be relocated to any lower region or regions of the toe, center, heel or any combination of these in the blade to create a lower center of gravity.

The new blade affords greater stability, reduces vibration upon impact with the puck or ball, reduces wobble of the blade in motion. This new weighting, weight removal and weight shifting or redistributing or relocating creates a more stable blade condition for launching the puck or ball to the desired location on its desired trajectory. This new weighting, weight removal, mass removal, material removal creates a more stable blade condition while the hockey stick is being swung. The blades new aerodynamic condition reduction of drag force and weighting creates a more stable hockey blade throughout the hockey swing and more stability upon impact with the puck or ball.

The new hockey stick blade gets attached to the hockey stick shaft in any suitable way. Glued, epoxy, molded, Co-molded, compression molded, over wrapped, joined using any suitable materials, such as graphite, carbon fiber, fiber-glass, wood, metal, titanium, epoxy, thermoplastic etc. Any suitable method can be used to join the blade to the stick portion. The new hockey stick blade is used in the game of hockey, ice hockey, roller hockey, street hockey, men's hockey, ladies hockey, any form of hockey. The new hockey stick blade can be molded with the shaft to create a so-called one piece stick. The new hockey stick blade can be glued, fastened joined, epoxied, fused, molded, any suitable way to the hockey stick to create a so-called one piece stick-hockey parlance-terminology. The new hockey stick blade can be formed, pressed molded, compression molded, or shaped in any suitable manufacturing way in order to be made for right handed swingers and or left handed swingers.

The new hockey stick blade can be formed, molded, pressed, shaped in any suitable method or manufacturing way in order to be shaped with any desired curve, loft, face angle, length, width desired and have any desired radius even or uneven in the face of the blade as desired by the player preference or players preferences.

The redistribution of weight can be achieved in many forms such as using the same material as the blade such as carbon fiber by using different density fiber in the redistributed or relocated area so that weight can be added to the desired location in or on the blade. The redistributed weight can be a different material than the blade itself meaning multi material construction, such as carbon fiber, wood, plastic, glass, fiber-glass, lead, metal, epoxy resin, foam, any form of metal, any form of resin, any form of plastic, thermoplastic, tape, wire. The redistributed weight can be made of any combination of suitable materials.

As hockey blades are usually designed to be kept as light as possible for a given design within the industry, therefore adding additional weight to the blades as currently constructed and designed makes them less desirable, compared to the newly invented hockey stick blade which sources the weight from the blade itself so that this does not increase the overall weight of the blade from its own sourcing.

The new hockey stick blade is more aerodynamic, reducing drag forces. The surface area at the top edge and below is reduced creating a more efficient blade for cutting through the air on the hockey swing and the blades wind resistance and drag forces are reduced. Less wind resistance acts upon the blade, creating more stability, while the blade maintains the higher toe for impact stability. This is achieved with a solid face structure, without putting holes in the face, which is not a solid face hockey stick.

The top surface and region can have an easy to see concave shape from heel to toe.

The concave radius can start from its top high surface (top line of the blade) at a distance as high as 3 inches in height when measured from the sole of the blade. As the current hockey rule states how to measure a blade. On the new blade, the valley, lowest portion should be 2 inches from the sole of the hockey blade sole. The radius can be within the above parameters or boundaries. Meaning that the lowest valley would be 2 inches from the sole of the blade and the highest point would lead to or be no more than 3 inches from the sole of the hockey stick blade. Any shapes and configurations can be suitable leading from the top heel to the top toe or the top toe to the top heel. The lowest point will be between the top toe area and the top heel area of the blade. The lowest point can be center of the concave shape. The lowest point can be more heel biased. The lowest point can be more toe biased in the blade.

Another embodiment can have the lowest portion of the concave top surface or line be from a minimum of 1.5 inches up to 2 inches on the preferred embodiment, however it can be anywhere from 1.5 inches up to 4 inches, any measurement from the 1.5 inches up to the 4 inches as long as below the top line measured from the sole to the points on either side of the top toe and heel are the starting point for the concave section so the concave will be below the toe and heel on either side of the toe and heel of at the top of the face or top line.

The highest point of the concave starting at the top toe and top heel of the top line or top of face will be anywhere from 2 inches to a maximum 4" from the sole of the blade.

Another embodiment would have the blade of the new stick blade at a height measure from the sole of the blade to the uppermost point of the top line be anywhere from a minimum of 2 inches to maximum of 3 inches.

There may be many suitable radiuses that can be achieved within the above mentioned dimensions. All can be suitable. Uneven, not true consistent radius can also be used. The weight reducing and redistribution can be achieved by reducing the weight in the upper region as mentioned and to make the blade more aerodynamic as mentioned. The upper region when looking at the face can have concave shape with and arc type upper wall or with straight walls or a combination of straight and arced walls and beveled walls. It can be all curved walls or any combination of arced to straight. Beveled walls and edges on the outer surfaces of the blade are preferred in the preferred embodiment.

Another embodiment can be straight walls or angled straight walls on the toe side of the concave and on the heel side of the concave and a straight bottom wall of the concave arc type shaping. All walls can have beveled edges. The angled walls can be any suitable angle. Angles can be from 1 degree to 179 degrees.

Another embodiment can have combination of straight, angled and curved walls leading into the valley curve on the toe side and straight, angled and curved walls leading into the heel side of the valley wall on the new hockey stick blade. The valley wall can have radius wall, angle wall or straight wall or any combination of wall types on the hockey stick blade. Beveled edges are preferred on the walls regardless of the arc, angle or straight nature of the wall itself. The angles walls can be any suitable angle. Angles can be from 1 degree to 179 degrees.

Another embodiment can have a light weight material such as foam, polymer, and thermoplastic, carbon fiber or the like, any suitable material to fill in the shown concave portion in the drawings in order to construct or design and make a normal looking blade with the capability of still redistributing saved weight from the upper top line region and allowing the saved weight or any portion of the saved weight to be redistributed to lower locations to lower the center of gravity of the hockey stick blade. The saved weight is the difference between the material removed or designed out in that region and the material that replaces or is designed into that region which is lighter than the material that surrounds it.

The embodiment realizes the fact that a reduction of the weight from the top line is more advantageously used at locations below the top line which makes the blade more stable when the puck or ball is struck off the ice or other surfaces in roller or street hockey.

The new hockey stick blade in realization of the fact that redistributing saved weight from the upper portion is beneficial to lowering the center of gravity of the hockey stick blade. It also allows for placement or redistribution of weight in locations that will add to the resistance of twisting of the hockey stick blade. Multi materials can be used to proportion the weight distribution of a blade to allow for lower center of gravity of the blade.

The new hockey stick blade realizes that there are areas that need structural integrity in the blade design and manufacture and there is an area in the top line area and top area center of face area, that can be made without structural weight. This frees up the saved weight from that area whether another lighter material takes place in that area or that area is totally free of any material.

Materials for making or constructing or designing the new hockey stick blade such as carbon fiber, varying weights of carbon fiber, varying thickens of carbon fiber, nylon, thermoplastic, foam, metal, ferrous, non-ferrous materials, fiberglass, resin, wood, plastic, engineered resin, titanium, multi material construction such as carbon fiber and foam, carbon fiber and thermoplastic, epoxy or any combination of above mentioned materials or any suitable materials or combination of the suitable materials.

The weight of the hockey stick blade in the new invention can be anywhere from 90 grams or liter to 1000 grams. Range anywhere from 90 grams to 1000 grams based on the specifications required to the particular stick for the particular player.

The preferred embodiment will have a blade in the range from 125 to 170 grams. The new blade function is more effective regardless of the starting overall blades weight or overall weight. The reduction of weight will be achieved regardless of starting weight. The new blade allows for the redistribution of weight-saved weight, to other regions in the blade preferably at lower locations sourcing the weight from the blade itself. The sourcing of weight from the blade itself allows more efficient weight distribution in the blade. This is done without increasing the overall weight of the blade from its redistribution.

The starting weight for the selected hockey stick blade for example is 150 grams and remains as such in the inventive blade after weight distribution and redistribution according to the present invention. In this regards, underlying the present invention is the recognition that in a typical use of a hockey stick blade the puck or ball is never intentionally struck near or at the top edge of the blades face, and thus removal of the top edge central or central to heel portion incident to its redistribution is totally consistent with the continued use of the hockey stick as intended. By way of further explanation, for example, if the removed blades portion was from the toe, this would certainly affect the use of the hockey sticks blade because a "toe" hit is part of the game, even intended, it can and does occur. In contrast, a "top edge" hit with the blade for all practical, intended purpose, or typical purpose, does not occur.

The starting weight for the selected hockey stick blade for example is 150 grams and remains as such in the inventive blade after weight distribution and redistribution according to the present invention. In this regards, underlying the present invention is the recognition that in a typical use of a hockey stick blade the puck or ball is never intentionally struck near or at the top edge of the blades face, and thus removal of the top edge central weight or central to heel portion weight incident to its redistribution is totally consistent with the continued use of the hockey stick as intended. By way of further explanation, for example, if the removed blade portions weight was from the toe, this would certainly affect the use of the hockey sticks blade because a "toe" hit is part of the game, even intended, it can and does occur. In contrast, a "top edge" hit with the blade for all practical, intended purpose, or typical purpose, does not occur.

Reducing the toe would create more twisting upon impact with the puck or ball. In contrast reducing the upper central portion, central-heel portion as mentioned reduces the center of gravity and reduces the twisting upon impact with the puck or ball.

The description of the invention above and below, together with the accompanying drawings, should not be construed as limiting the invention to the example shown and described, because those skilled in the art to which this invention appertains will be able to devise other forms thereof within the ambit of the appended claims.

Views of hockey stick blades for right handed swing are shown. A view of a left handed stick blade would be a mirror image of what is shown.

It should be understood that, while it is within the contemplation of the present invention to always remove the construction material preparatory to weight distribution from the top edge, the relocation is not limited to a rear sole location along the toe, central and heel portions thereof, but can advantageously be at only the toe, only the central portion, only at the heel, and at any combinations of such locations. The selection for removal from the top edge or top central portion results from the recognition that, in the typical use of a hockey blade, the ball or puck is never intentionally struck near or at the top of the blade face but always at the "sweet spot" or below, and thus removal of the top edge central portion incident to its relocation is totally consistent with the continued use of the hockey blade as intended. By way of further explanation, for example, if the removed blade portion is from the toe, this would certainly adversely affect the use of the hockey blade because a "toe" hit is part of the game, it can and does occur. In contrast, a "top edge" hit with a blade for all practical purposes or normal intended uses does not occur.

While the hockey blade for practicing the within inventive method, as well as said method herein shown and disclosed in detail, is fully capable of attaining the objects and providing the advantages hereinbefore stated, it is to be understood that it is merely illustrative of the presently preferred embodiment of the invention, and that no limitations are intended to the detail of construction or design herein shown other than as defined in the appended claims.

DETAILED DESCRIPTION OF THE PREFERRED EMBODIMENTS

Figure 1A:
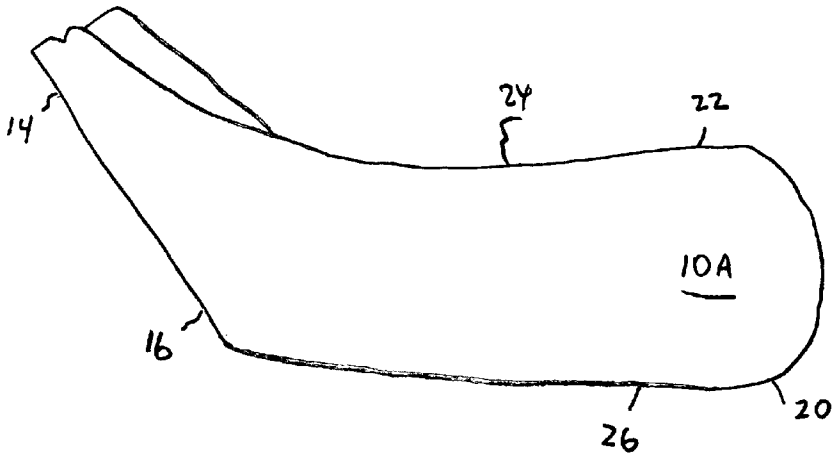
FIG. 1A PRIOR ART
FIG. 1A is a prior art hockey stock blade

As already well known and illustrated in prior art FIG. 1A typical hockey stick blade, generally designated 10A, herein is assembled at the distal end of a shaft 12 connected with the hosel 14 to constitute a usable hockey stick 15.

As best understood from the enlarged scale depictions of the hockey blade 10 of FIG. 1A the body of the hockey stick blade includes, in addition to the hosel 14, a heel 16, a central ball or puck striking surface 18 and a toe 20. The actual body 22 presenting the striking face 18 is typically of wood or carbon fiber construction material and bounded by a top edge 24 and a bottom edge 26, and sometimes said face 18, in hockey parlance, is referred to a "sweet spot" particularly the specific area 18A thereof between line of demarcation 28 and 30 delineating surface 18 from the toe 20 and heel 16.

Reference should now be made to the illustration of the inventive hockey stick blade 10 as shown in FIG. 1-13 in which to enhance an understanding of the patentable differences over the prior art hockey stick blades of FIG. 1A, the same parts are designated by the same, but primed reference numerals. The significant difference is best understood from a consideration of FIG. 3, the removal of the carbon fiber construction material, or whatever construction material, is being used such as carbon fiber per se, or composite or the like, as denoted by area 38 illustrated in phantom perspective, from the specifically selected location in the medial length portion of the upper or top edge 24 and relocating this removed weight to a clearance position below area 38 to preferably the inside of the lower region toward the sole or rear of the bottom edge 26, said relocated area being more particularly denoted and designated 40. An improvement in the center of gravity by lowering the weight in the blade with attended efficiency resulting from the sweet spot hit and also, as observed in practice, an improvement in results even with off-center toe or heel hit of the hockey puck or ball.

Figure 1:
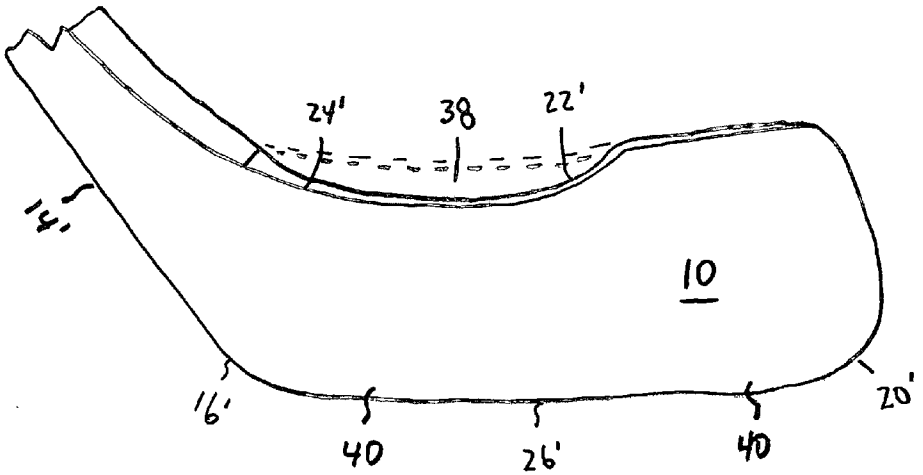
FIG. 1 is a perspective view of the hockey stick blade rear for right handed swing
Figures 2, 3:
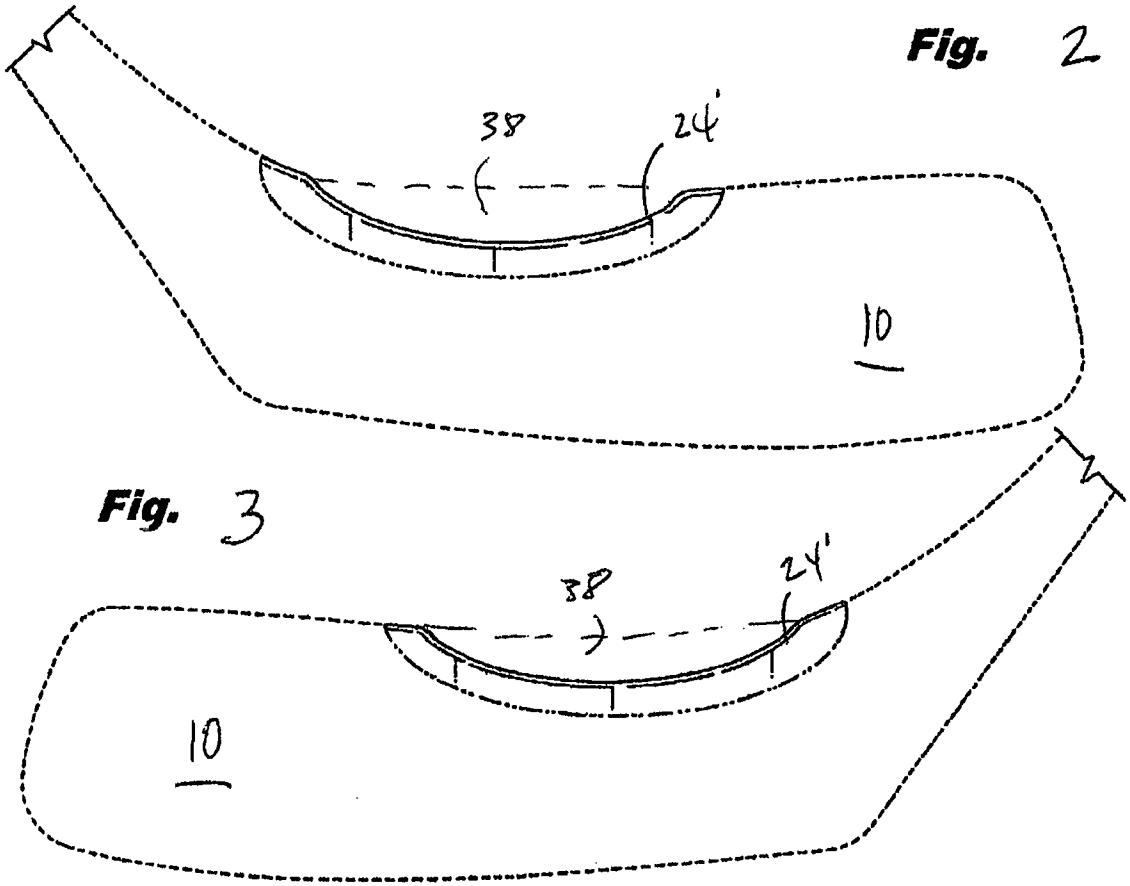
FIG. 2 is a rear elevation view
FIG. 3 is a front elevation view
Figure 4:
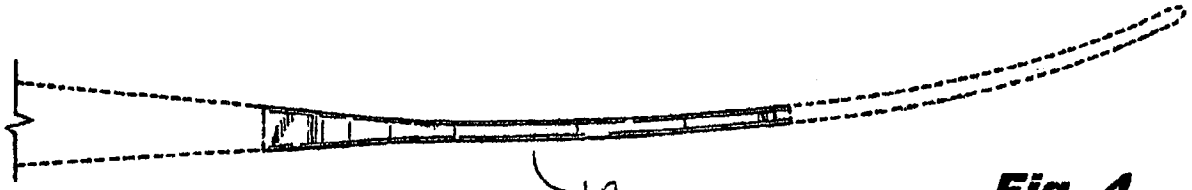
FIG. 4 is a top plan view
Figure 5:
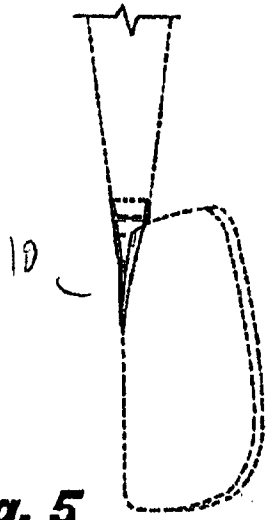
FIG. 5 is a left side elevation view
Figure 6:
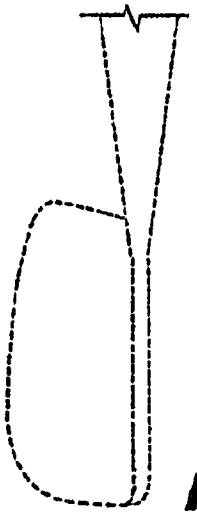
FIG. 6 is a right side elevation view
Figure 7:
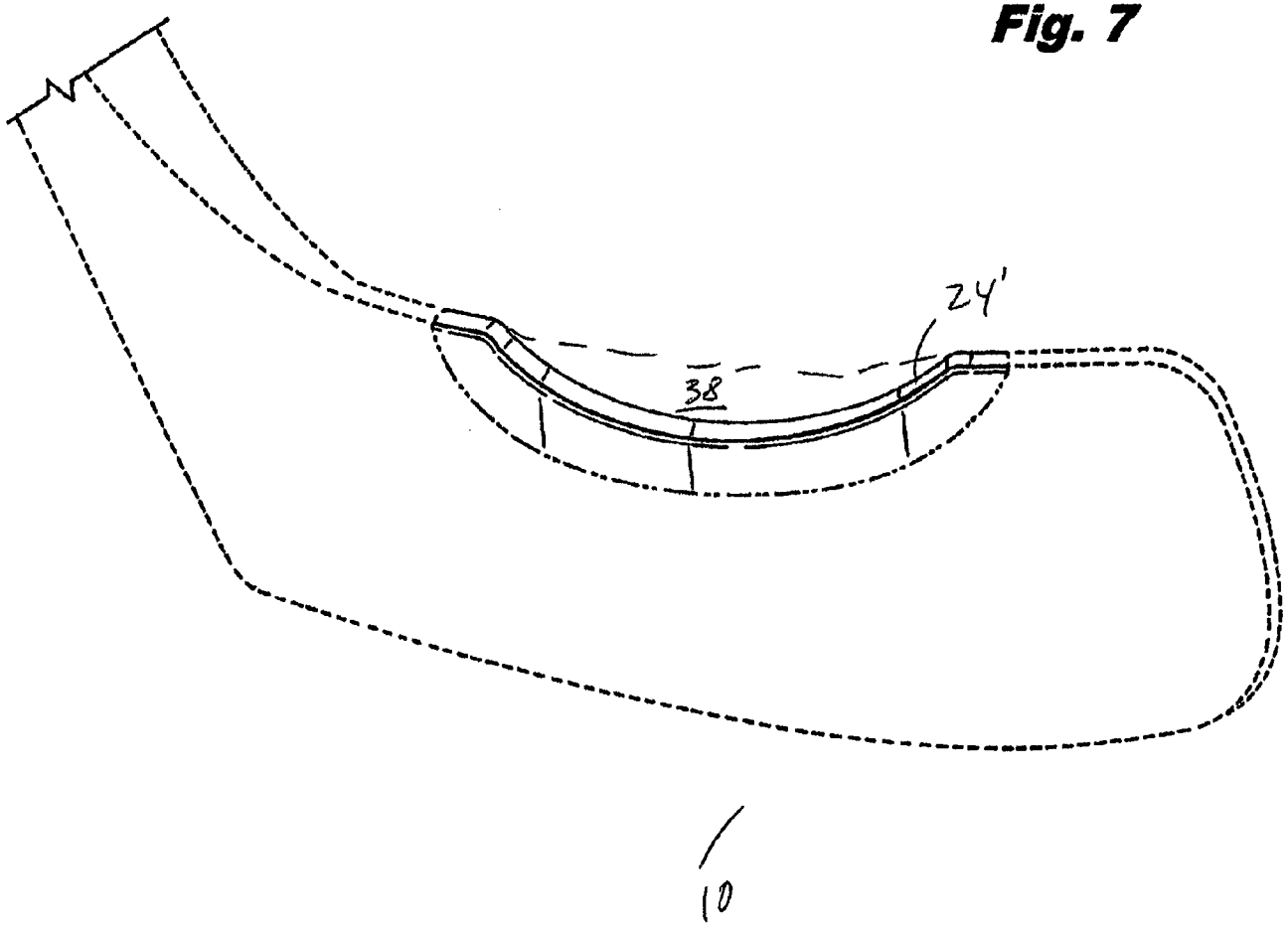
FIG. 7 is a perspective view of the rear of the blade
Figure 8:
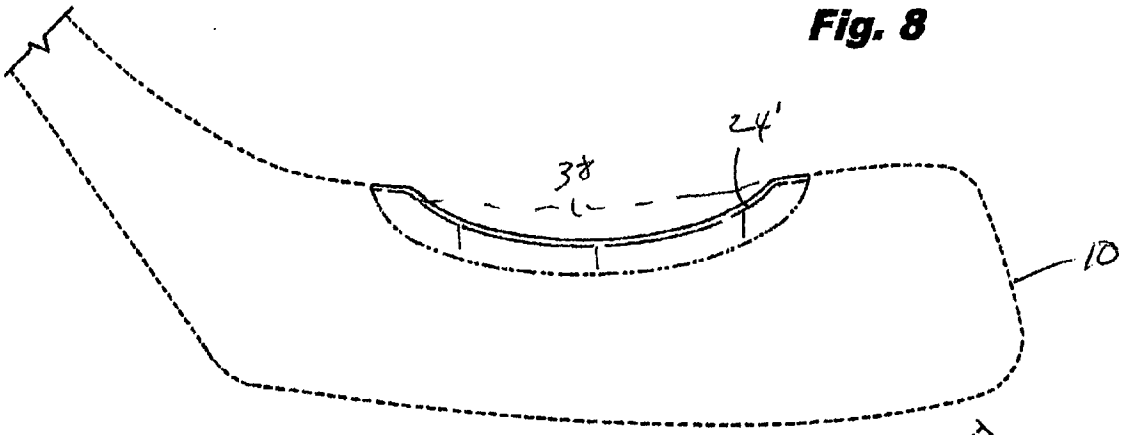
FIG. 8 is a rear elevation
Figure 9:
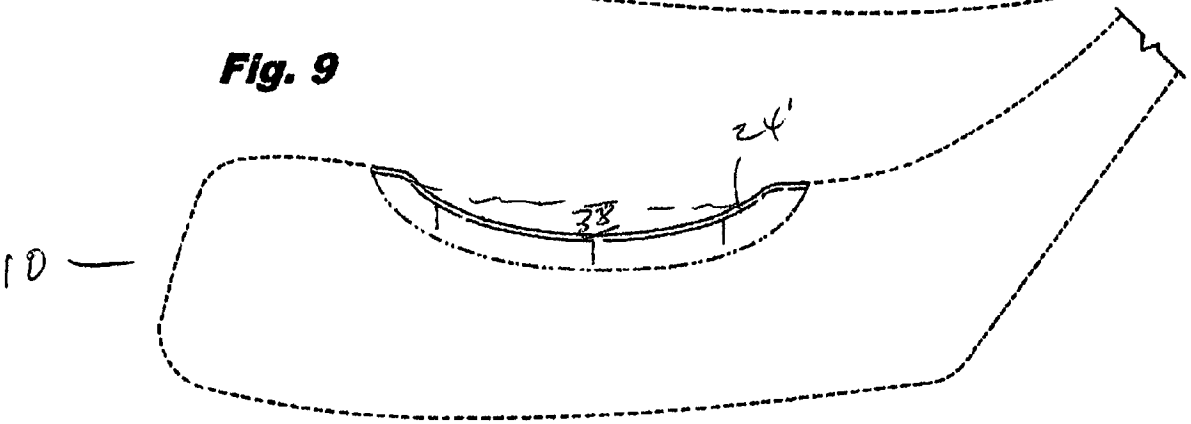
FIG. 9 is a front elevation
Figure 10:
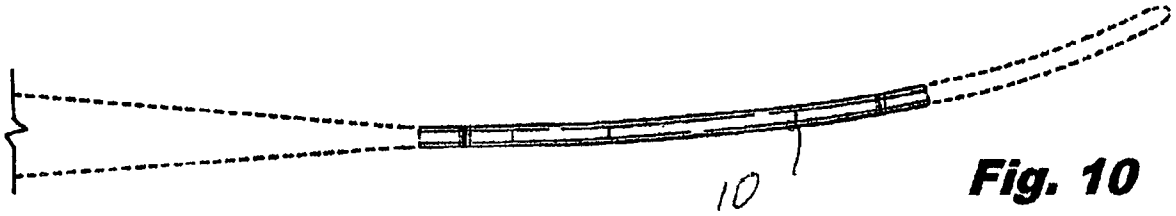
FIG. 10 is a top plain view
Figure 12:
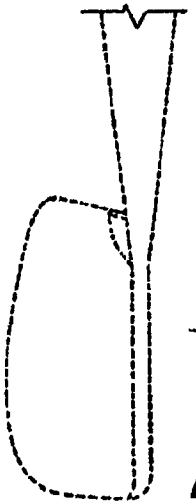
FIG. 12 is a right side elevation view.
Figure 11:
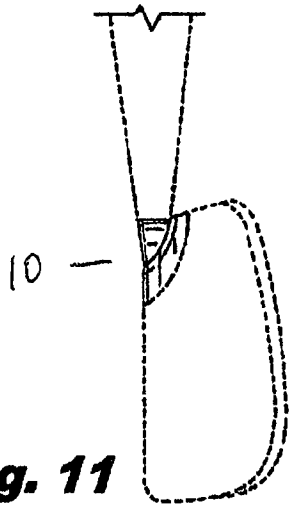
FIG. 11 is a left side elevation view

Not only is the removed weight 38 better utilized at location 40 for the ball or puck-striking function intended, but the removal from location 38A noted in FIG. 1 is from the worst location adversely bearing on the efficacy of the hockey stick blade center of mass.

To demonstrate this point, it is noted that is common practice in the manufacture of hockey stick blades to employ internal ribbing, which adds weight to the blade. It should be understood that, while it is within the contemplation of the present invention to always remove the construction material preparatory to weight distribution from top edge 24'. The relocation is not limited to the inside and/or outside of rear sole location 40, i.e. along the toe, central and heel portions thereof, but can advantageously be at only the toe, only the central portion, only at the heel, any combination of such locations. The selection for removal from the top edge 24' results from recognition that, in the typical use of a hockey stick blade. The puck or ball is never intentionally struck near or at the top of the hockey stick blades face 18', but always at the "sweet spot" or below and thus removal of the top edge central portion incident to its relocation is totally consistent with the continued use of the hockey stick blade as intended. By way of further explanation, for example, if the removed hockey stick blade portion is from the toe, this would certainly adversely affect the use of the hockey stick blade because a "toe" hit is part of the game, even though possibly not intended because it can and does occur. In contrast, a "top edge" hit with the hockey stick blade for all practical purposed, never occurs.

Figure 13:
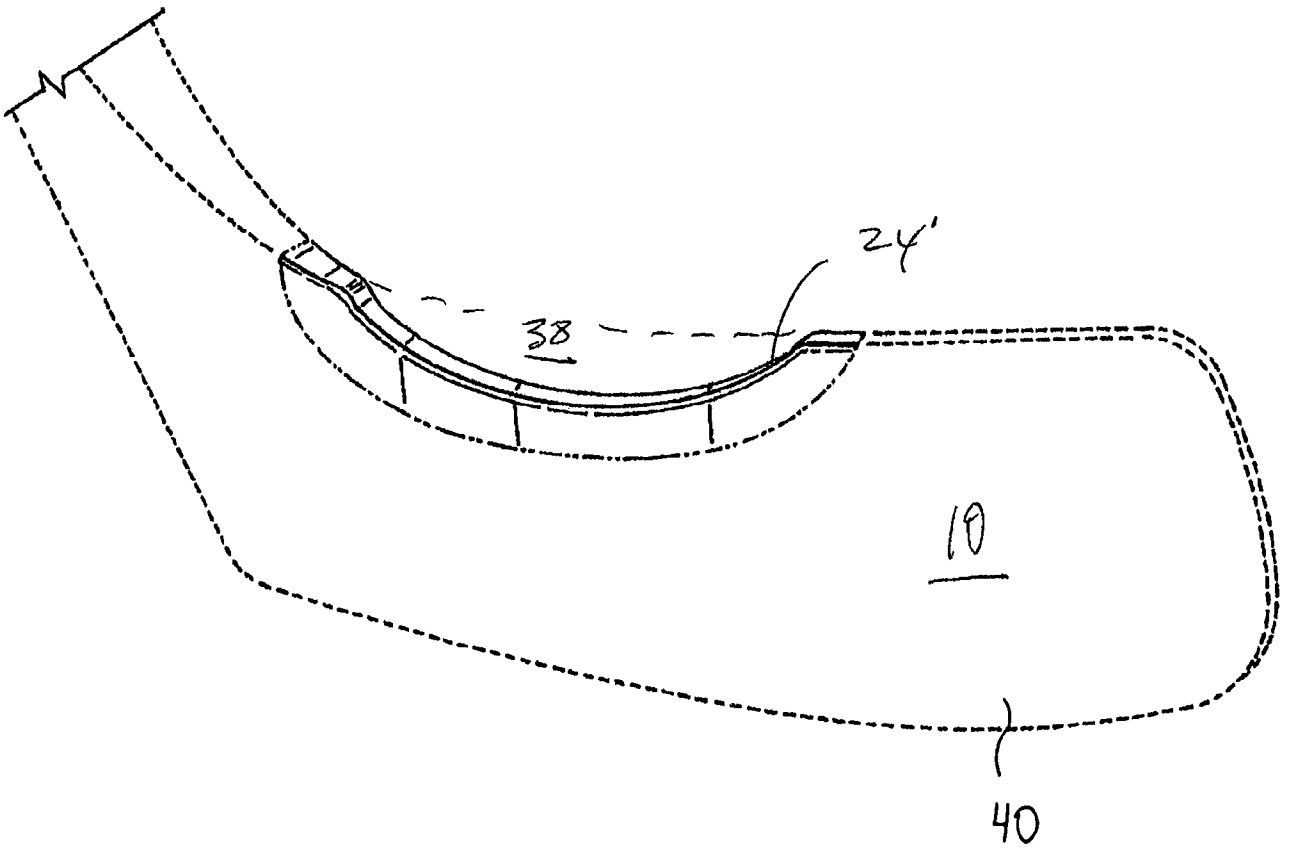
FIG. 13 shows the blade with removed weight and redistributed gravity
Figure 13A:
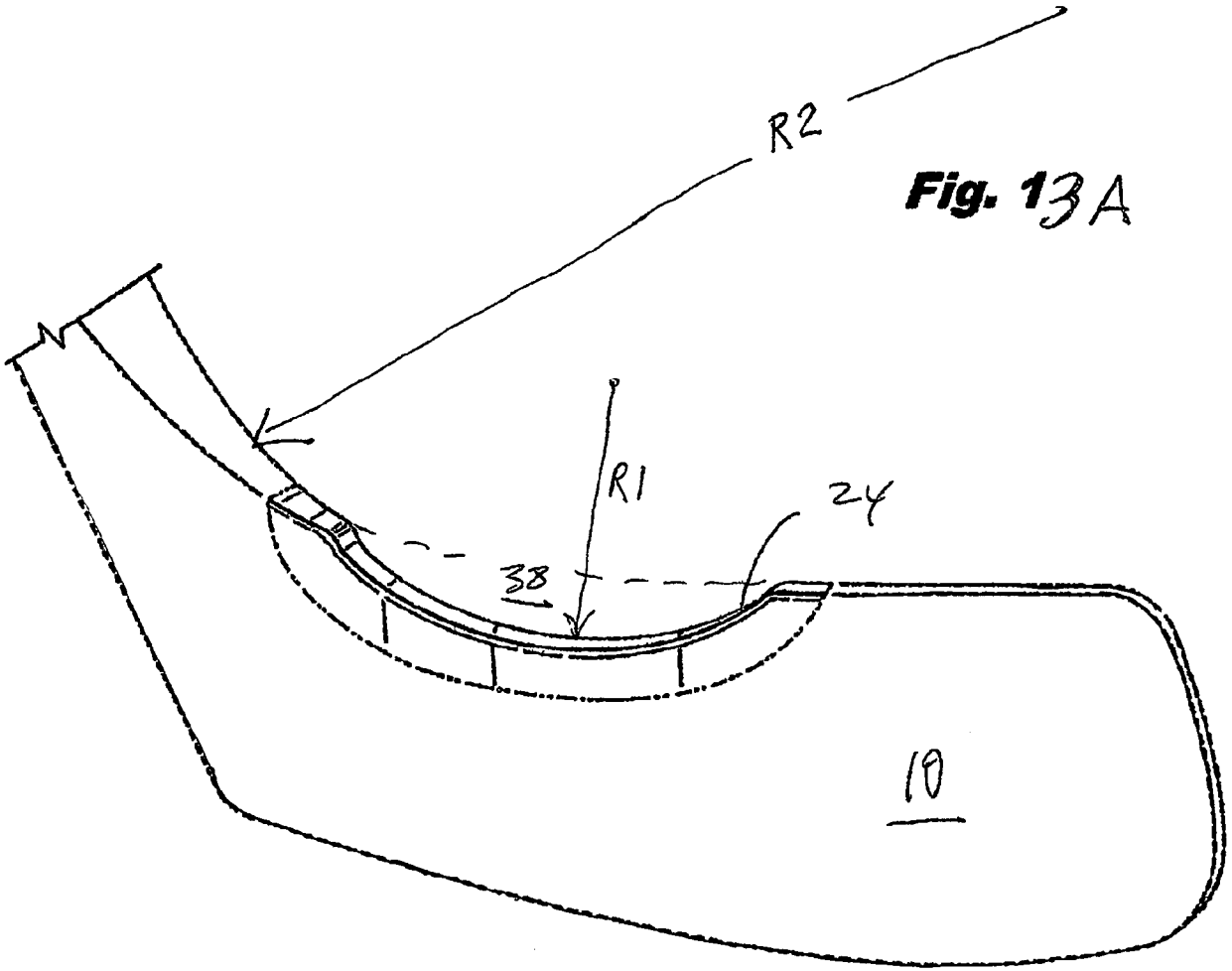
FIG. 13A is a side view of the blade showing the concave cutout portion and its smaller radius, compared to the overall larger radius of the tapered top of the hockey stick blade.

FIG. 13A shows a hockey stick blade 10 having a cutout portion 38 above a concave top edge portion 24 of the hockey stick blade 10. The cutout portion 38 has a radius "R1" smaller than the overall radius "R2" of the tapered top edge 24 of the hockey stick blade 10. The sense of curvature of the opposite end of the top edge 24 changes at the point of where the top edge 24' of the concave cutout portion 38 begins. The sense of curvature of the opposite end of the top edge 24' of the concave cutout portion 38 changes at the point where it meets the remainder of the opposite side of the tapered top edge 241 of the hockey stick blade 10.

While the hockey stick blade for practicing the within inventive method, as well as said method herein shown and disclosed in detail, is fully capable of attaining the objects and providing the advantages herein before stated, it is to be understood that it is merely illustrative of the presently preferred embodiment of the invention, and that no limitations are intended to the detail of construction or design herein shown other than as defined in the appended claims.

The mentioned reduction of drag forces is more influential on a hockey stick than on a golf club head as shown on U.S. Pat. No. 5,486,000 because a golf club is swung much faster than the hockey stick. The swing is longer in golf. The golf iron face surface is smaller and much shorter than on a hockey stick blade. Conversely, The drag on a hockey blade is much greater as the size, length of a hockey stick blade is in the 12 inch range verses a golf head that is approximately 3" in length. A hockey stick has a flat surface on both sides and is swung much slower in hockey than golf. These factors increases the drag force on the hockey stick blade. The hockey blade is also built differently than a golf iron head. The golf head can have protrusions and various back shapes, cavities, dimensions and weighting. The hockey stick blade has the back surface like the shape of the front surface. It is a thin in depth, long in length, a blade which creates higher drag force when swung at the speeds a hockey stick are swung. The hockey stick blade is also unbalanced with a heavy bias toward the heel and neck area of the stick. The drag forces also act upon a hockey stick blade greater than on a golf iron head. A golf iron head can have the center of mass of the club head in the center of the blade from heel to toe and does not get drag force influenced like that of a hockey stick blade. Drag force is calculated by multiplying drag area (and other factors) by Velocity Squared. Thus velocity is very important to drag force because it is a function of velocity squared . . . hence golf (fast) small drag area, versus Hockey swing (slow), large drag area.

What is claimed is:

1. In a hockey stick blade of a type having a puck-striking body of weight-imparting construction material inclined at a selected angle for driving a struck puck a corresponding selected height during its trajectory, said body having spaced-apart top and bottom surfaces bounding a striking surface there between, said body of the blade improving aerodynamics and reducing drag force, of the blade swing against the puck, said body having a concave cutout portion, comprising removed construction material from said top surface, said removed material in the form of the concave cutout descending down from a curved tapered top surface of said hockey blade, said concave cutout having a top edge having a sense of curvature with a smaller radius than a larger radius of the tapered top surface of the hockey blade, whereby said removed construction material is removed from a location not used during puck-striking service of said hockey stick blade, and said removed construction material benefits in lightening the overall weight of the said hockey stick blade and thereby reducing drag force against said hockey stick blade, thereby moving the hockey sticks balance point more toward the top of the stick.

2. In a hockey stick blade of a type having a puck-striking body of weight-imparting construction material inclined at a selected angle for driving a struck puck a corresponding selected height during its trajectory, said body having spaced-apart top and bottom surfaces bounding a striking surface there between, said body of the blade improving weight distribution of the blade swing against the puck, said body having a concave cutout comprising removed construction material from said top surface, at least part of said removed construction material or its weight from top surface being relocated to clearance positions below said top surface located toward bottom surface, said removed material in the form of the concave cutout descending down from a curved tapered top surface of said hockey blade, said concave cutout having a top edge having a sense of curvature with a smaller radius than a larger radius of the tapered top surface of the hockey blade, whereby said removed construction material is removed from a location not used during puck-striking service of said hockey stick blade, and said removed construction material in said relocated positions contribute to increasing said height attained by the struck puck.

3. A method of improving the reduction of drag forces of a hockey stick of selected construction material constituting a hockey stick blade with a puck-striking surface bounded in vertical perspective by top and bottom surfaces and in horizontal perspective by toe and heel portions, said method comprising the steps of removing construction material from a central portion of said top surface, said removed material in the form of the concave cutout descending down from a curved tapered top surface of said hockey blade, said concave cutout having a top edge having a sense of curvature with a smaller radius than a larger radius of the tapered top surface of the hockey blade whereby the removed construction material from a location not used during puck-striking service of the hockey stick blade allows for the improvement in reducing drag forces in the hockey stick blade.

4. The method of improving the reduction of drag forces of a hockey stick, a hockey stick of selected construction material constituting a hockey stick blade with a puck-striking surface bounded in vertical perspective by top and bottom surfaces and in horizontal perspective by toe and heel portions, as in claim 3, said method allowing for the balance point in the hockey stick to move upwards on the shaft due to the overall weight of the blade being reduced and thereby reducing drag force against said hockey stick blade.

* * * * *